US008297724B2

(12) United States Patent
Hämmerle

(10) Patent No.: US 8,297,724 B2
(45) Date of Patent: Oct. 30, 2012

(54) DRAWER FRAME WITH A FASTENING DEVICE FOR A FRONT PANEL

(75) Inventor: Jürgen Hämmerle, Lustenau (AT)

(73) Assignee: Julius Blum GmbH, Hoechst (AT)

( * ) Notice: Subject to any disclaimer, the term of this patent is extended or adjusted under 35 U.S.C. 154(b) by 212 days.

(21) Appl. No.: 12/652,903

(22) Filed: Jan. 6, 2010

(65) Prior Publication Data

US 2010/0102692 A1 Apr. 29, 2010

Related U.S. Application Data

(63) Continuation of application No. PCT/AT2008/000165, filed on May 13, 2008.

(30) Foreign Application Priority Data

Jul. 11, 2007 (AT) ..... A 1072/2007

(51) Int. Cl.
*A47B 88/00* (2006.01)

(52) U.S. Cl. ..... 312/348.4; 312/348.2; 312/265.5

(58) Field of Classification Search ..... 312/348.1, 312/348.2, 348.4, 265.5, 330.1, 257.1, 263
See application file for complete search history.

(56) References Cited

U.S. PATENT DOCUMENTS

| | | | | | |
|---|---|---|---|---|---|
| 2,716,583 | A * | 8/1955 | Straubel | 312/303 |
| 4,846,538 | A * | 7/1989 | Rock et al. | 312/263 |
| 4,850,659 | A * | 7/1989 | Rock et al. | 312/263 |
| 5,163,774 | A * | 11/1992 | Lautenschlager | 403/245 |
| 5,364,181 | A * | 11/1994 | Scheible | 312/348.4 |
| 5,540,515 | A * | 7/1996 | Rock et al. | 403/322.4 |
| 5,664,857 | A * | 9/1997 | Lautenschlager et al. | 312/348.4 |
| 5,860,718 | A * | 1/1999 | Brustle | 312/348.2 |
| 5,895,103 | A * | 4/1999 | Huber | 312/348.4 |
| 6,179,399 | B1 * | 1/2001 | Brustle et al. | 312/348.4 |
| 6,457,791 | B1 * | 10/2002 | Muterthies et al. | 312/348.4 |
| 6,981,752 | B2 * | 1/2006 | Harn et al. | 312/348.4 |
| 7,055,919 | B2 * | 6/2006 | Lam Harn et al. | 312/348.4 |
| 7,207,637 | B2 * | 4/2007 | Huang | 312/348.4 |
| 7,540,577 | B2 * | 6/2009 | Netzer | 312/348.4 |
| 2006/0049730 | A1 * | 3/2006 | Sutterlutti | 312/330.1 |
| 2010/0102692 | A1 * | 4/2010 | Hammerle | 312/348.4 |

FOREIGN PATENT DOCUMENTS

| | | | |
|---|---|---|---|
| DE | 299 14 388 | U1 | 1/2000 |
| EP | 0 740 917 | A1 | 11/1996 |
| EP | 0 761 130 | A2 | 3/1997 |
| EP | 0 740 917 | B1 | 11/1998 |
| EP | 1 516 561 | A1 | 3/2005 |

OTHER PUBLICATIONS

International Search Report issued May 25, 2009 in International (PCT) Application No. PCT/AT2008/000165.
Austrian Search Report issued Jan. 8, 2008 in A 1072/2007.

* cited by examiner

*Primary Examiner* — James O Hansen
*Assistant Examiner* — Daniel Rohrhoff
(74) *Attorney, Agent, or Firm* — Wenderoth, Lind & Ponack, L.L.P.

(57) ABSTRACT

A drawer frame includes a fastening device for fastening a front panel to the drawer frame in a releasable and preferably adjustable manner. A fitting part is premounted on the front panel, and a spring-loaded catch part is arranged in the drawer frame. When the fitting part is inserted, the catch part automatically draws the fitting part towards the drawer frame. A locking apparatus is provided for the catch part, and the locking apparatus is in the form of a clamping apparatus.

28 Claims, 12 Drawing Sheets

DRAWER FRAME WITH A FASTENING DEVICE FOR A FRONT PANEL

This application is a continuation application of International application PCT/AT2008/000165, filed May 13, 2008, the entire disclosure of which is incorporated herein by reference.

BACKGROUND OF THE INVENTION

The present invention relates to drawer frame comprising a fastening device for the releasable and preferably adjustable fastening of a front panel to the drawer frame, in which a fitting is pre-assembled to the front panel. Arranged in the drawer frame is a spring-loaded catch member which automatically pulls the fitting towards the drawer frame when being engaged with one another, and a locking device is provided for the catch member.

The invention also relates to a drawer and a piece of furniture which has a drawer frame of the kind described.

Drawer frames of this kind can be connected, for example, as frame attachments to a rail of a pull-out guide assembly for drawers. These frame attachments, in turn, have fastening possibilities for a drawer base, a drawer rear wall and also for a front panel. European Patent EP 0 740 917 B1 by the Applicant discloses a connecting fitting for detachably fastening a front panel onto drawer frames, wherein the front panel, or the fitting thereof, can be latched automatically to the drawer frame by a spring-loaded catch member. When the front panel is in the assembled position with respect to the catch member, a blocking bar is provided which engages a notch of the catch part. In particular, in the case of heavily laden drawers, it can frequently happen that the front panels perform a slight tilting movement with respect to the drawer frame due to the manual force applied to the front panel. This relative movement is undesirable since it results in a delay in the movement of the drawer, and therefore does not satisfy the need for optimum movement in some situations.

EP 0 761 130 A2 discloses a fitting for mounting front panels of drawers, wherein a pivotable locking element engages on a flap-like projection associated with the front panel.

SUMMARY OF THE INVENTION

It is an object of the present invention to disclose a drawer frame of the kind mentioned in the introduction, wherein secure mounting of the front plate, and, preferably in addition, numerous adjustment possibilities of the front panel shall be made possible.

According to a favorable embodiment of the invention, this is achieved in that the locking device is in the form of a clamping device.

In the simplest case, this locking can be attained by a pin which can be brought into operative engagement with the catch member in such a way that the fitting of the front panel is not only held by the spring force of the fastening device, but is additionally locked in a stable position to prevent relative movement of the catch member in the locked position. In this way, the fitting of the front panel which is locked with the catch member can be rigidly connected to the drawer frame in a substantially play-free manner.

According to a preferred embodiment, it can be provided that the locking device by the force of a spring automatically locks the catch member in the position in which it retains the fitting. In such a case, it is therefore not necessary to activate the locking device separately by additional manual actuation.

In a preferred embodiment of the invention, the locking device can be released in order to adjust a position of the front panel relative to the drawer frame. In this case, the front panel remains secured to the drawer frame by way of the usual fastening device, but the selective position of the front panel relative to the drawer frame can be specifically adjusted.

From a constructional viewpoint, the configuration can be such that the locking device has at least one wedge member which is movable—preferably rotatable about an axis—and which locks the catch member in a first operating position and releases the catch member in a second operating position. In this respect, it can be provided that in the first operating position, the wedge member forms a clamping connection between the catch member and an abutment member associated with the drawer frame. In addition to a friction locking, a positive connection can also be provided for directly or indirectly arresting the catch member.

According to another embodiment of the invention, the wedge member may have at least one guide track, preferably a control cam or a connecting link guide, along which the wedge member can be moved relative to the abutment member. The form of the guide track is selected so that the force acting upon the catch member can be adjustably varied, which can be made possible by a bent or curved shape of the same, for example. In this way, on the one hand, the wedge member can be brought into a wedged position between a stationary abutment member and the catch member, and, on the other hand, the wedge member—preferably by rotation of same—can be moved into a position in which the fitting of the front panel is held solely by the exerted force of the spring which acts on the catch member. In this respect, the arrangement of a spring is advantageous (either in the form of the spring of the catch member, or, possibly, also in the form of a separate spring) which automatically urges the wedge member into the wedged position.

BRIEF DESCRIPTION OF THE DRAWINGS

Further details and advantages of the present invention will become apparent from the following description of the drawings, wherein.

DETAILED DESCRIPTION OF THE INVENTION

Figure 1:
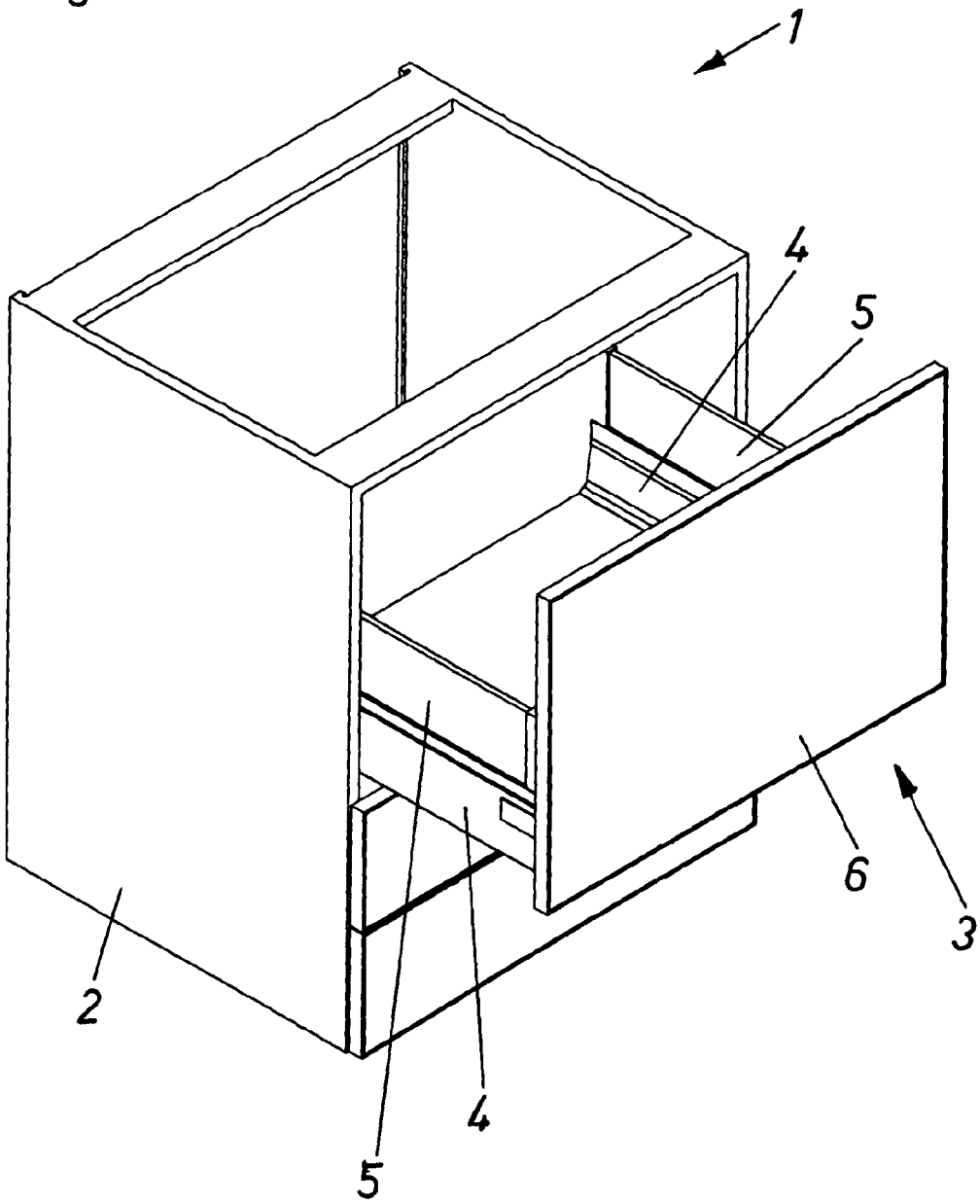
FIG. 1 shows a cabinet-like piece of furniture with a drawer which has drawer frames according to the invention.

FIG. 1 is a perspective view of a cabinet-like piece of furniture 1 comprising a furniture body 2 and drawers 3 being displaceable thereto. The drawers 3 have lateral drawer frames 4 and frame attachments 5 which are arranged at least regionally above the frames. The drawer frames 4 are configured in such a way that they can be connected to a front panel 6, to a drawer base, to a drawer rear wall and to a pull-out guide assembly for drawers (not shown). Particularly with respect to the drawer 3 shown uppermost in the piece of furniture 1, the front panel 6 of which exceeds the height of the drawer frame 4 to a considerable extent. Hence, when a handle is actuated in the region of the upper edge of the front panel 6, a tilting movement of the front panel 6 is triggered relative to the drawer frame 4 due to the leverage force which is being applied, since the front panel 6—as is customary in the prior art—is only held to the drawer frame 4 by a spring-loaded catch member. Because of this problem, the present invention proposes to disclose an improved fastening device of the drawer frame 4 in order to attach the front panel 6, as will be described in greater detail in the following section.

Figure 2:
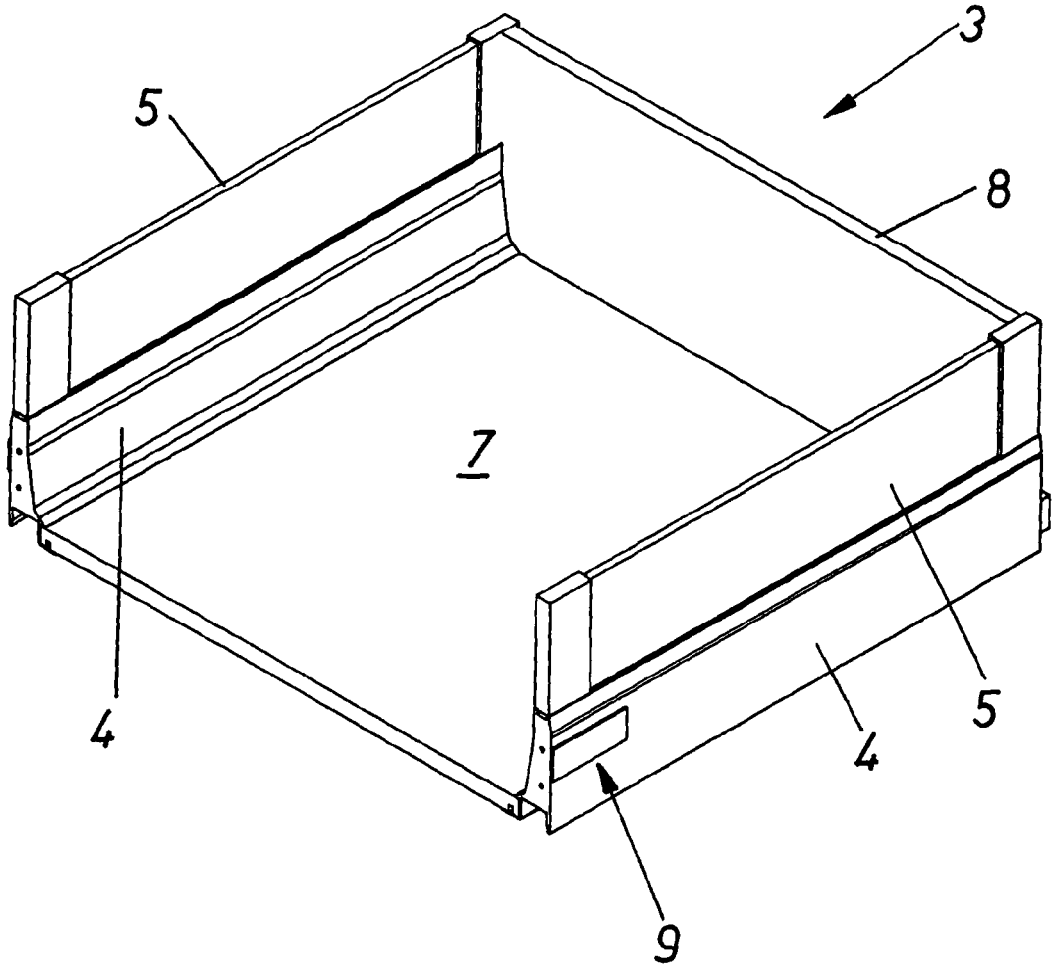
FIG. 2 shows the drawer of FIG. 1 with drawer frames according to the invention and the front panel removed.

FIG. 2 shows a perspective view of the drawer 3 with the front panel 6 removed. The drawer 3 has lateral drawer frames 4 and frame attachments 5 which are provided for the purpose of increasing the capacity of the drawer 3. A drawer base 7 and a rear wall 8 can also be seen. The drawer frame 4 comprises a fastening device 9 which is arranged in the front region of the drawer frame 4 and which lies completely behind the front end face of same. It can be seen that the drawer frame 4 is configured as a double-walled hollow drawer frame, whereby all components of the fastening device being arranged in the hollow chamber thereof.

Figure 3:
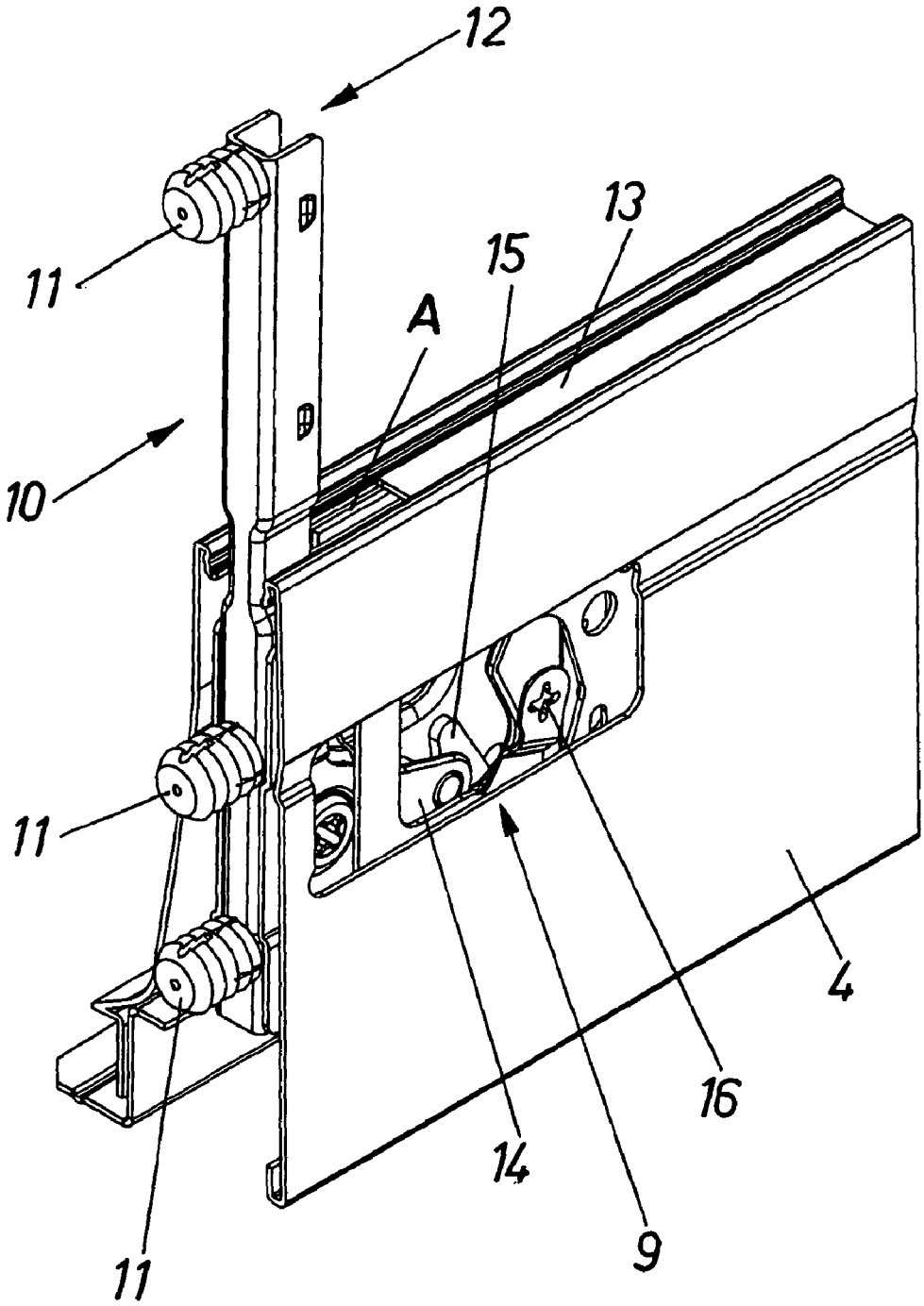
FIG. 3 shows the front portion of a drawer frame with the fitting for the front panel in the arrested position.

FIG. 3 shows the front region of the drawer frame 4 with the fitting 10 which has to be mounted onto the front panel 6. The fitting 10 has pegs 11 for anchoring to the front panel 6, not shown. In the illustrated embodiment, the height of the fitting 10 exceeds the height of the drawer frame 4, and, for reasons of stability, the region 12 of the fitting 10 which projects beyond the drawer frame 4 is, at least regionally, of U-shaped profile. A continuous groove 13 is formed in the upper side of the drawer frame 4, and the lower side of the frame attachment 5 is inserted in the groove 13. In the upper side of the drawer frame 4 it is also possible to see an opening A which is provided for the passage of the fitting 10. The fitting 10 has a retaining member 14 which latches onto a catch member 15 of the fastening device 9. The catch member 15 is acted upon by a spring, not shown in this drawing. If the fitting 10 needs to be detached, a screwdriver is simply placed on the lateral receiving means 16, and turned in a clockwise direction, whereupon the fitting 10 is released from the fastening device 9.

Figure 4A:
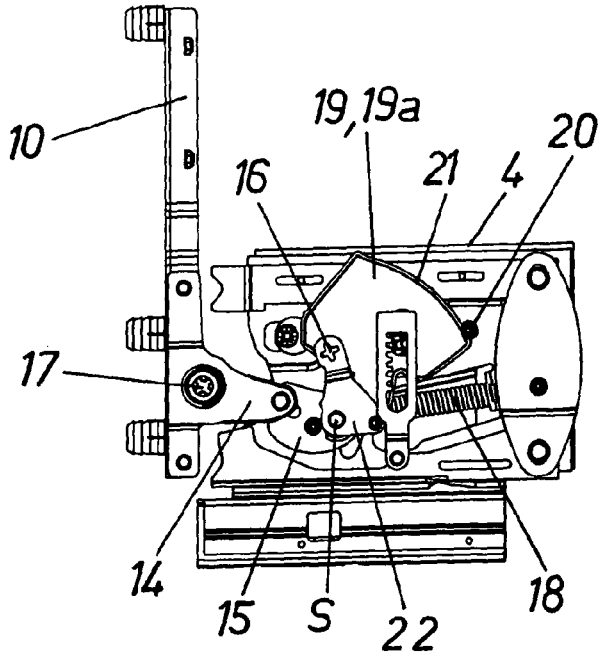
FIGS. 4*a*-4*c* show the temporal sequence of engaging the fitting on the drawer frame, wherein the locking device is arrested automatically.
Figure 4B:
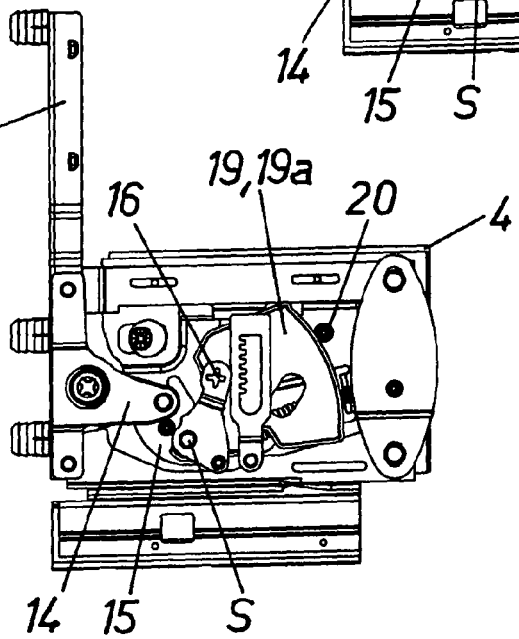
Figure 4C:
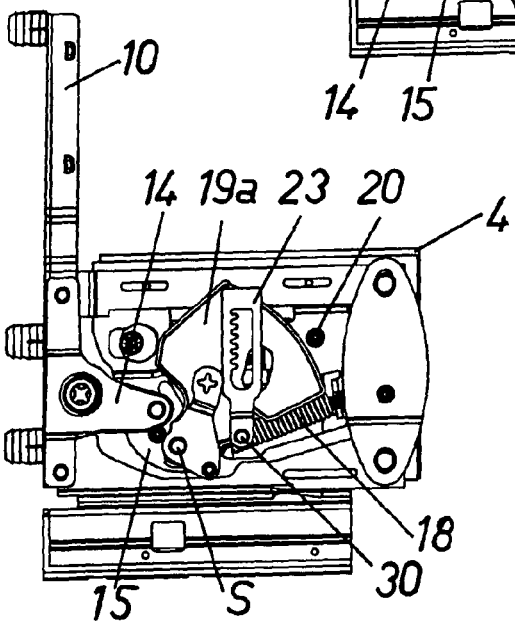

FIGS. 4*a*-4*c* are side views showing time sequences in the process of connecting the fitting 10 of the front panel 6 with respect to the fastening device 9 of the drawer frame 4. The fitting 10 can be seen with the laterally projecting retaining member 14 and a lateral adjustment device 17 thereof, by means of which the front panel 6 can be adjusted in the assembled position laterally to the drawer frame 4. FIG. 4*a* shows the start of the latching process, wherein a catch member 15, subject to the action of a spring 18, remains in a tensioned stand-by position. Upon introduction of the retaining member 14, this latter is drawn into the drawer frame 4, and both members 14, 15 are automatically locked with each other, with the catch member 15 pivoting in a clockwise direction about an axis of rotation. According to the invention, an additional locking device 19 is provided which comprises at least one wedge member 19*a*. The wedge member 19*a* is pivotally mounted and has a guide track 21 in the form of a curved control cam which is able to run along a stationary abutment member 20 which is in the form of a pin. In FIG. 4*a*, the wedge member 19*a* is in a non-arrested position.

If the retaining member 14 is brought together with the catch member 15, the catch member 15 pivots in a clockwise direction due to the action of the spring 18, whereupon the entire fitting 10 is drawn towards the drawer frame 4. This position is shown in FIG. 4*b*. It can also be seen that the wedge member 19*a* with the guide track 21 thereof has also been pivoted automatically in a clockwise direction by the action of the spring 18, so that the wedge member 19*a* is now securely wedged between the rigid abutment member 20 and the point of rotation S. In this way, the catch member 15 is not only held by the prevailing spring force, but also additionally locked, and so the front panel 6, not shown here, can be connected to the drawer frame 4 in a substantially play-free manner. In this way, undesirable relative movement between the front panel 6 and drawer frame 4 upon actuation of the drawer 3 can be minimized to a relatively large extent.

FIG. 4*c* further shows, in turn, the latched position between the fitting 10 and the catch member 15. However, the wedge member 19*a* has been loosened by means of a release device 23 from the rigidly clamped connection between the point of rotation S and the abutment 20, so that the relative position of the fitting 10 (and therewith of the front panel 6) can be adjusted. In the embodiment shown, the release device 23 is formed by a height-adjustable slider which is movable vertically by means of a screwdriver, causing the wedge member 19*a* to pivot back again to some extent. An outer wall (not shown here) of the drawer frame 4 has an opening which permits passage of a screwdriver. The screwdriver engages on the toothed section of the release device 23, wherein a journal 30 which is fixedly connected to the release device 23 causes height adjustment of the wedge member 19*a* in order for the friction-locked connection to be released.

Figure 5A:
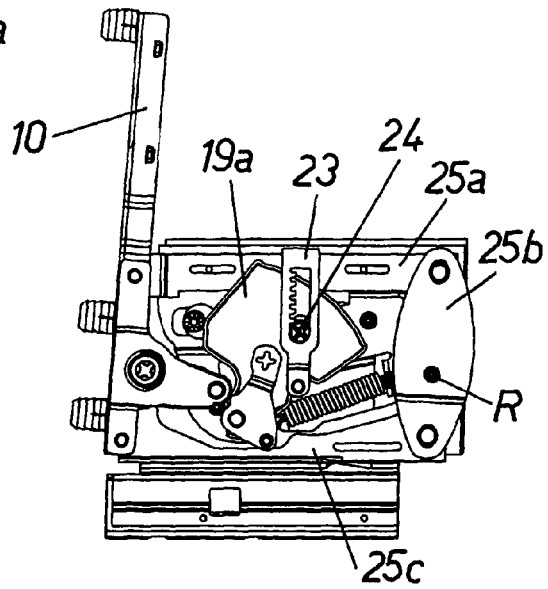
FIGS. 5*a*-5*c* show various positions of inclination of the front panel relative to the drawer frame with releasable locking device.
Figure 5B:
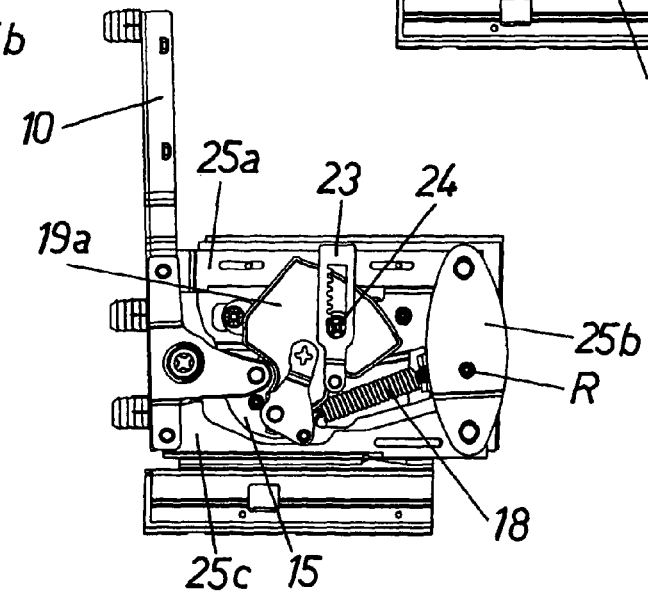
Figure 5C:
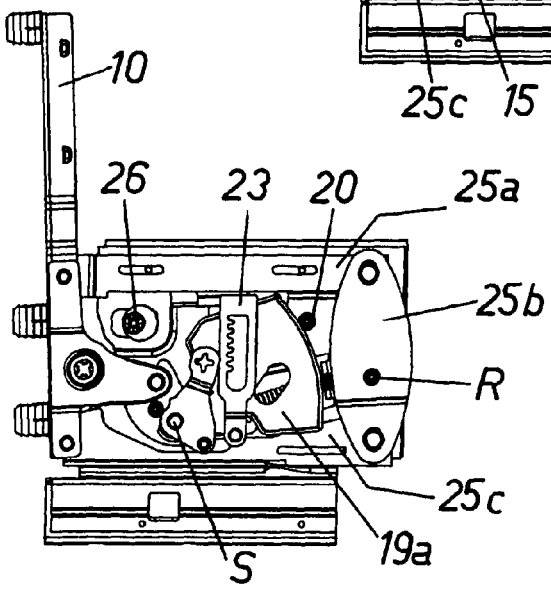

FIGS. 5*a*-5*c* show a fitting 10, based on FIG. 4*c*, in two different pivot positions. As can be seen in FIG. 5*a*, by placing and turning a screwdriver, the release device 23 can be lifted until the screwdriver can slip through the release device 23, whereupon in this second depth position an adjustment device 24 for adjusting the inclination of the front panel 6 can now be actuated. This adjustment device 24 for adjusting the inclination of the front panel 6 comprises a transmission gear with an adjustment wheel, wherein a rotation of the adjustment wheel causes linear movement of a lever 25*a* which runs along the upper side of the drawer frame 4, the lever 25*a* resting against the fitting 10 in the front region of the drawer frame 4. If the lever 25*a* is displaced by adjusting the adjustment device 24, then an intermediate lever 25*b* mounted at the point of rotation R brings about movement in the opposite direction of the lever 25*c* arranged at the underside of the drawer frame 4, that lever also resting against the fitting 10 in the front region of the drawer frame 4. In other words, a swinging movement acts onto the fitting 10 of the front panel 6. FIG. 5*a* shows the fitting 10 in an inclined position towards the upper region of the drawer frame 4, whilst FIG. 5*b*—as a result of the angular adjustment device 24 having rotated in the opposite direction—shows the fitting 10 in an outwardly pivoted position.

FIG. 5*c* shows a fitting 10 which has been adjusted in respect of its inclination, whereby the locking device 19 in the form of the wedge member 19*a* having wedged itself automatically between the point of rotation S and the abutment member 20. It has done this automatically because when the screwdriver was withdrawn from the drawer frame 4, the wedge member 19*a* was urged by the force of a spring (either by the spring 18 of the catch member 15 or by a separate spring) back into the first operating position—corresponding to the locked position of the wedge member 19*a*. In FIG. 5*c* it is also possible to see a height adjustment device 26 in the form of an eccentric, by means of which the height of the latched fitting 10 can be adjusted in relation to the drawer frame 4. This height adjustment device 26 is known in the prior art, and therefore does not need to be described in greater detail here.

Figure 6:
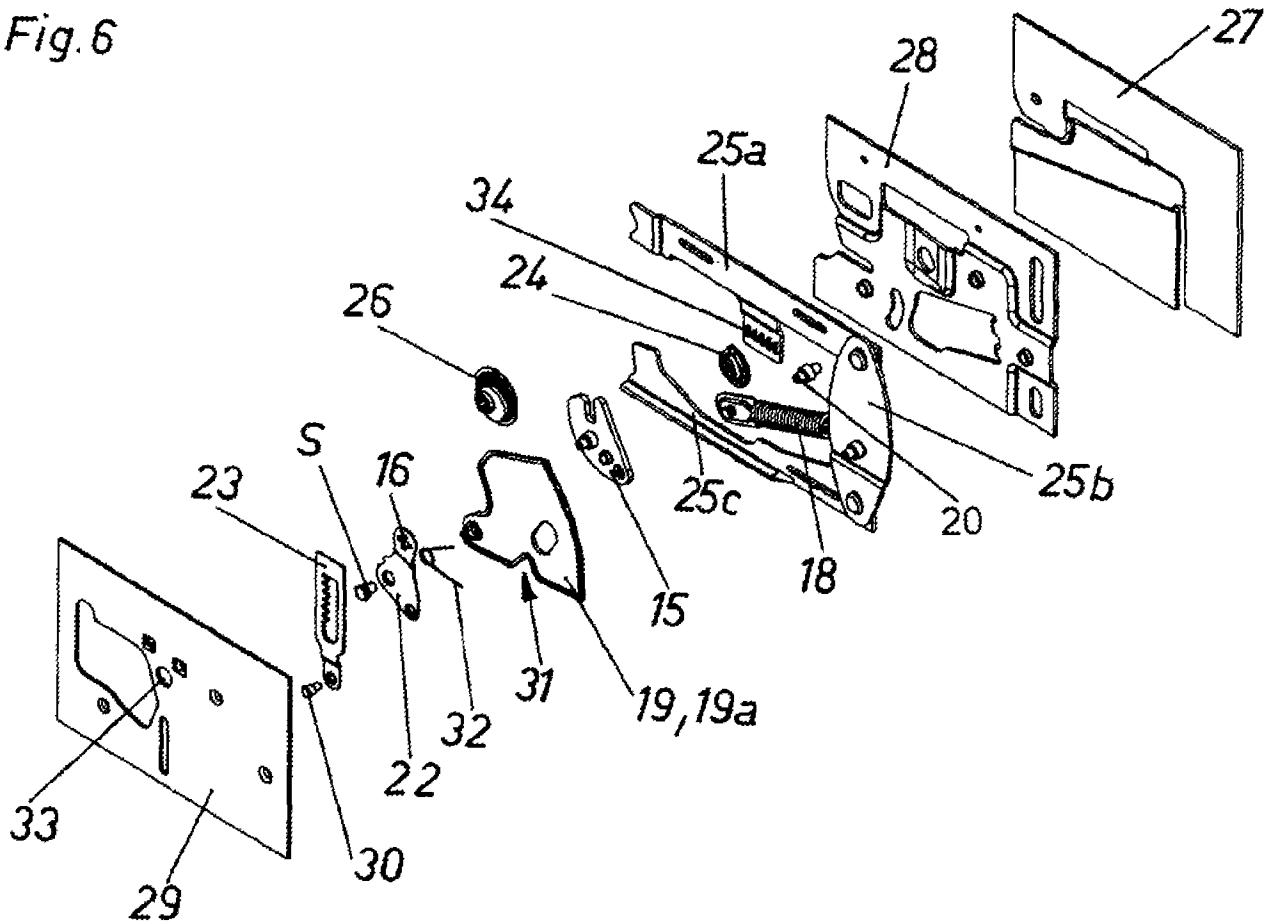
FIG. 6 is an exploded view of the components used.

FIG. 6 shows an exploded view of the components used, all of which can be arranged within the hollow chamber of the drawer frame 4. An assembly plate 28 is arranged on a base plate 27 fixedly connected to the drawer frame 4, the assembly plate 28 being movable relative thereto by means of the height adjustment device 26 in the form of an eccentric. The lever apparatus with levers 25*a* and 25*c* can also be seen, and the levers 25*a* and 25*c* are coupled to each other for movement by way of the shift lever 25*b*. The spring 18 acts upon the catch member 15 which is capable of latching to the retaining member 14, not shown here, of the fitting 10. The locking device 19 comprises a wedge member 19*a* in the form of a pivotable lever which can be wedged between the abutment member 20 and the axis of rotation S in the assembled position. To unlock the wedge member 19*a*, there is provided a release device 23 in the form of a slider by means of which the journal 30 can engage into the contour 31, and thereby move the entire wedge member 19*a* upwards during the course of unlocking (cf. FIG. 5*a*). For automatic locking, a leg spring 32 is provided to act upon the wedge member 19*a*, wherein the leg spring 32 constantly urges the wedge member 19*a* into the wedged position. Closure is by virtue of a retaining plate 29 with an opening 33 through which a screwdriver reaches as far as the toothed configuration of the release device 23 in a first depth position, and reaches as far as the adjustment wheel of the adjustment device 24 for inclining the front panel 6 in a second depth position. The adjustment device 24 with its adjustment wheel is mediated by a connected toothed configuration 34—arranged on the lever 25*a*—via the levers 25*a* and 25*c* which are coupled for movement.

Figure 7A:
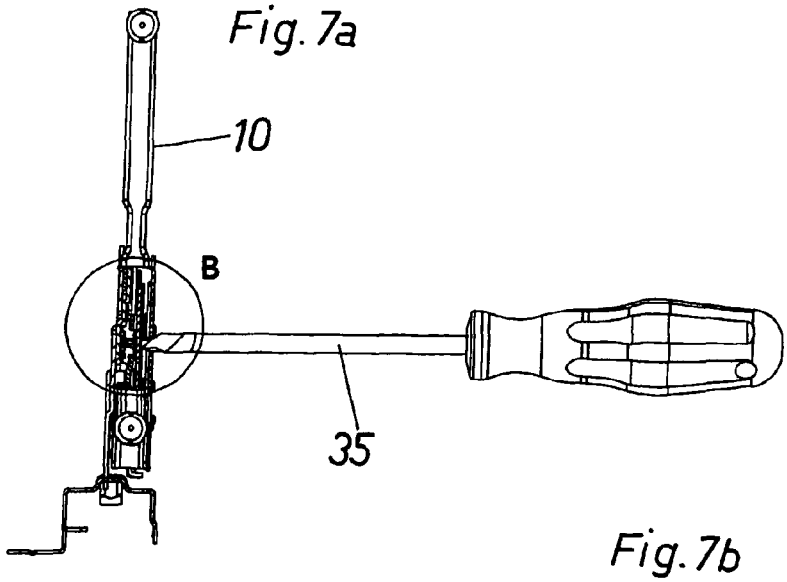
FIGS. 7*a*, 7*b* show vertical sections through the drawer frame during actuation of the release device, wherein the screwdriver is in a first depth position.
Figure 7B:
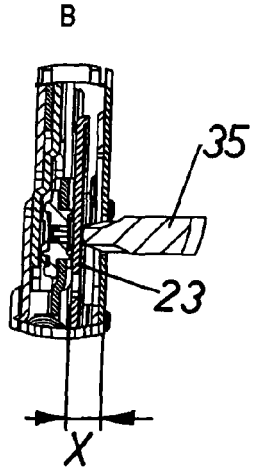
Figure 8A:
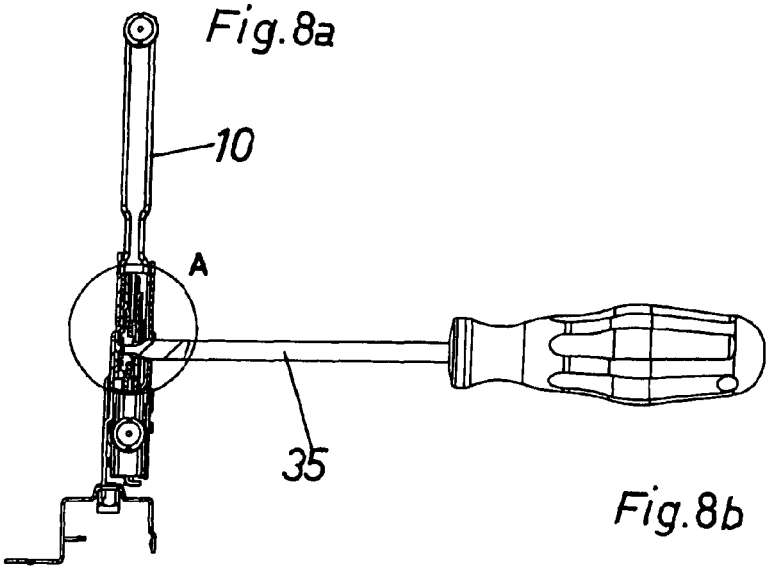
FIGS. 8*a*, 8*b* show similar vertical sections to FIGS. 7*a* and 7*b* during actuation of the angular adjustment device for the front panel, wherein the screwdriver is in a second depth position.
Figure 8B:
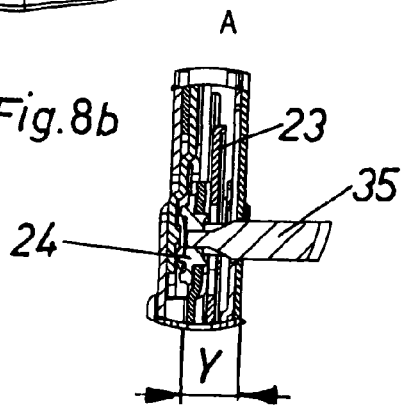

FIG. 7*a* is a vertical section through the fitting 10 during the course of the unlocking procedure; and FIG. 7*b* shows a detailed view of this on a larger scale. A screwdriver 35 is passed through the opening 33 (FIG. 6) in the retaining plate 29, whereby the release device 23 in the form of a slider moves the wedge member 15*a* out of the locked position. From FIG. 7*b* it can be seen that the screwdriver 35 adopts a first depth position X which extends in a perpendicular direction relative to the longitudinal direction of the drawer frames. If the release device 23 is rotated into its uppermost end position, the screwdriver can then be brought into a depth position Y which is displaced thereto (FIGS. 8*a*, 8*b*), wherein the adjustment wheel of the angular adjustment device 24 can be activated. If the screwdriver is withdrawn completely after the adjustment has been made, the release device 23 moves into its bottommost end position, and the wedge member 15*a* is, once again, automatically arrested by spring force.

Figure 9:
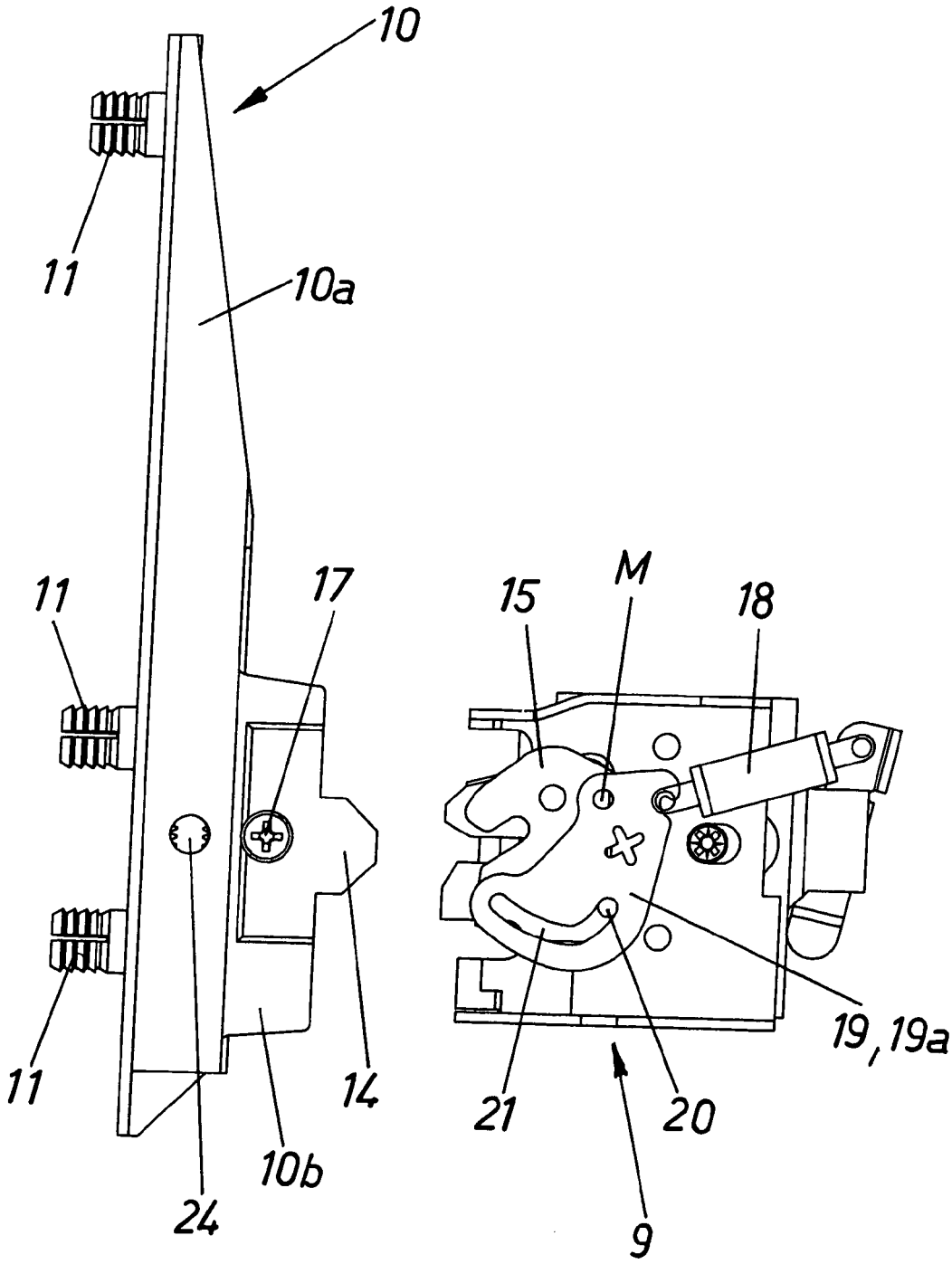
FIG. 9 shows an alternative embodiment of a locking device according to the invention.

FIG. 9 shows an alternative embodiment of the invention. The fitting 10 for the front panel 6 comprises two parts 10*a*, 10*b* which can be connected together and which are preferably adjustable relative to each other. The pegs 11 for securing the front panel 6 are mounted to the part 10*a*. The lateral adjustment device 17, known from the prior art, for adjusting the front panel 6 is arranged on the part 10*b*. The parts 10*a*, 10*b* are pivotally connected together by way of an angular adjustment device 24. The fastening device 9 associated with the drawer frame 4 in turn comprises a catch member 15 which can be acted upon by a spring 18. The locking device 19 has a wedge member 19*a* which is pivotally connected to the catch member 15 at the axis of rotation M. The wedge member 19*a* has a guide track 21—a link guide in the present case—by means of which the wedge member 19*a* can pivot along this guide track 21 around the stationary abutment member 20. FIG. 9 shows the catch member 15 in stand-by position in which this latter can be automatically latched to the retaining member 14 of the fitting 10.

Figure 10:
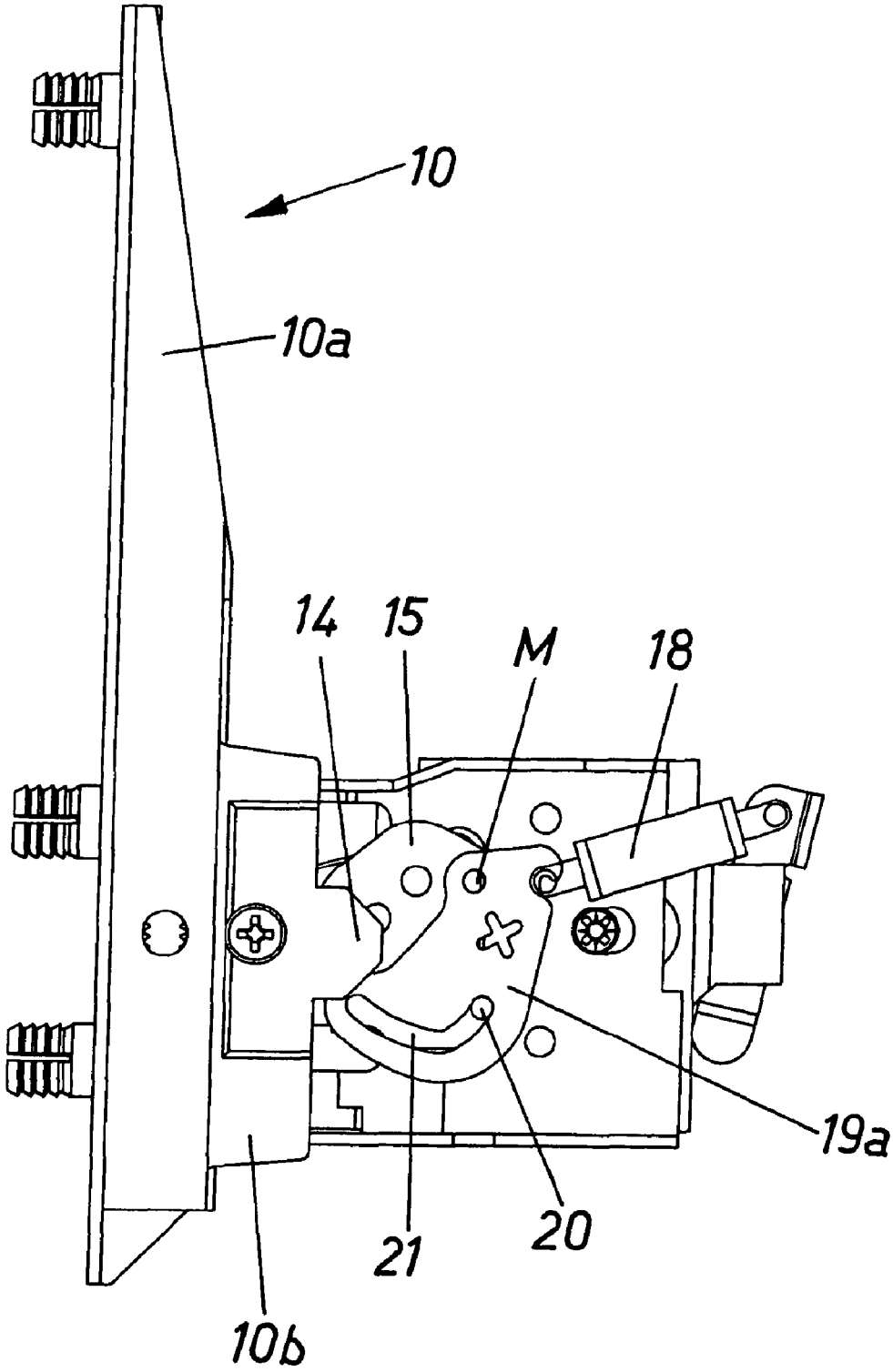
FIG. 10 shows the embodiment of FIG. 9, wherein the fitting is at the start of the latching operation.

FIG. 10 shows the moment shortly before latching takes place between the catch member 15 and retaining member 14. The spring 18 acts upon the catch member 15 via the wedge member 19*a*, so that upon release both the catch member 15 can be urged into its arrested position and the wedge member 19*a* can be urged into its locked position.

Figure 11:
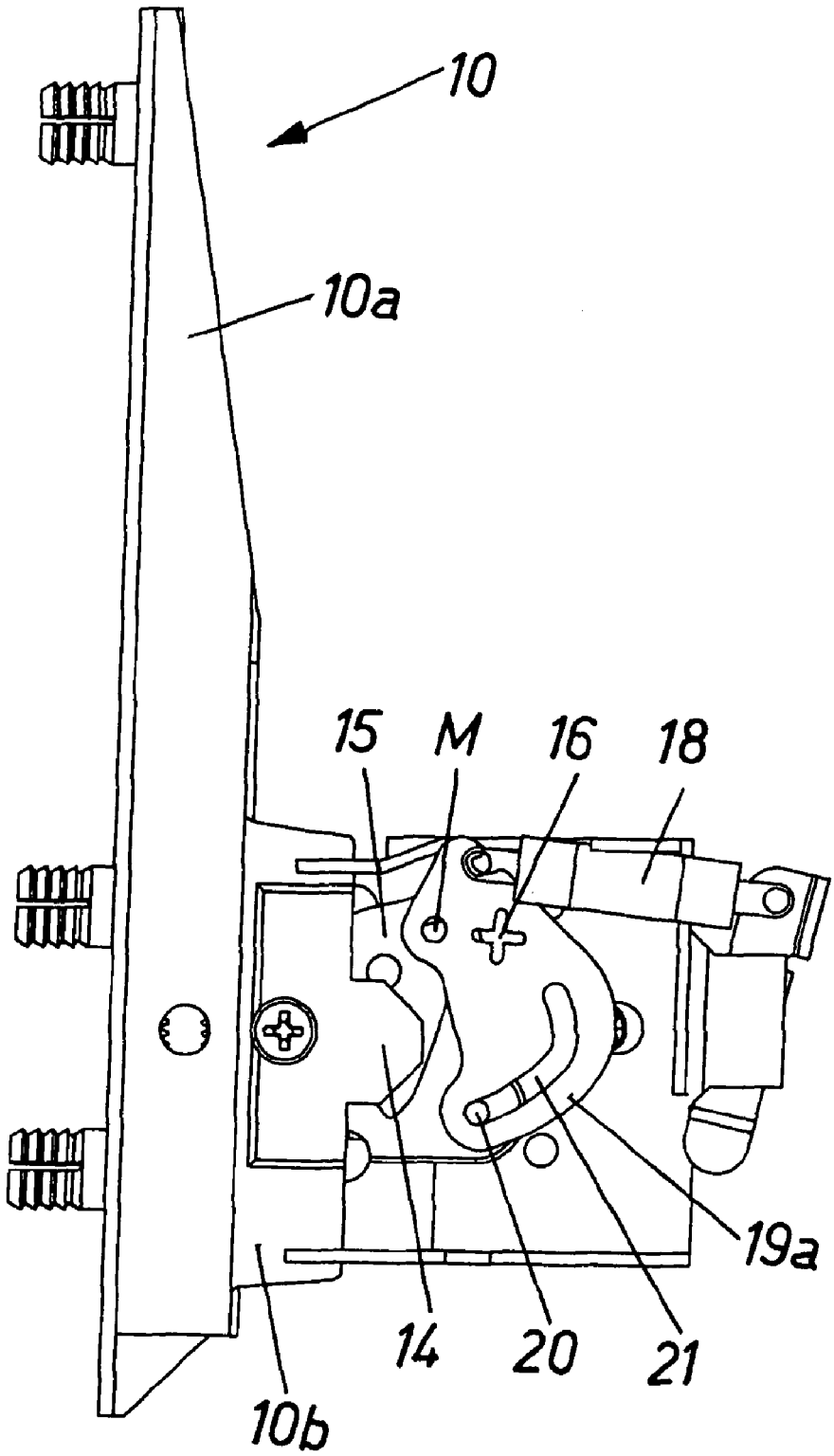
FIG. 11 shows the latched and additionally locked catch member of FIGS. 9 and 10, FIGS. 12*a*, 12*b* show vertical sections through the fitting during angular adjustment.

FIG. 11 then shows the catch member 15 in the fully latched and locked position. The pushing in movement of the retaining member 14 has caused the catch member 15 to move in a counter-clockwise direction and become latched. Furthermore, synchronous locking of the catch member 15 has taken place, with the wedge member 19*a* likewise having been pivoted in a counter-clockwise direction. It can be seen that the stationary abutment member 20 is at the opposite end of the guide track 21 from FIG. 10. The catch member 15 is therefore securely locked by the wedge member 19*a* between the point of rotation M and the stationary abutment member 20. To loosen the arrested position of the catch member 15 and of the locking device 19 to the wedge member 19*a*, a screwdriver simply has to be placed on the receiving means 16 and turned in a clockwise direction.

Figure 12A:
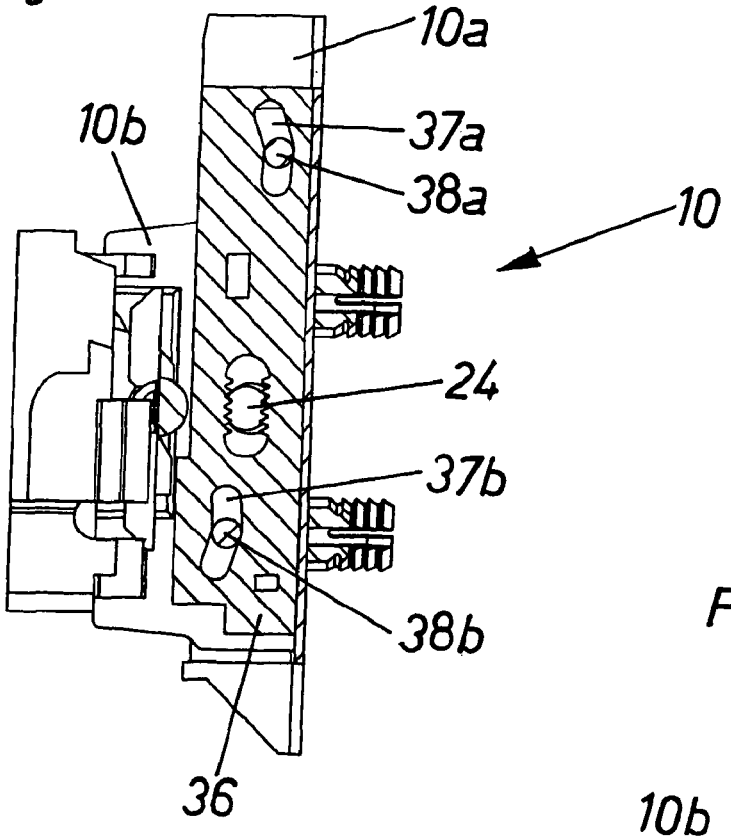
Figure 12B:
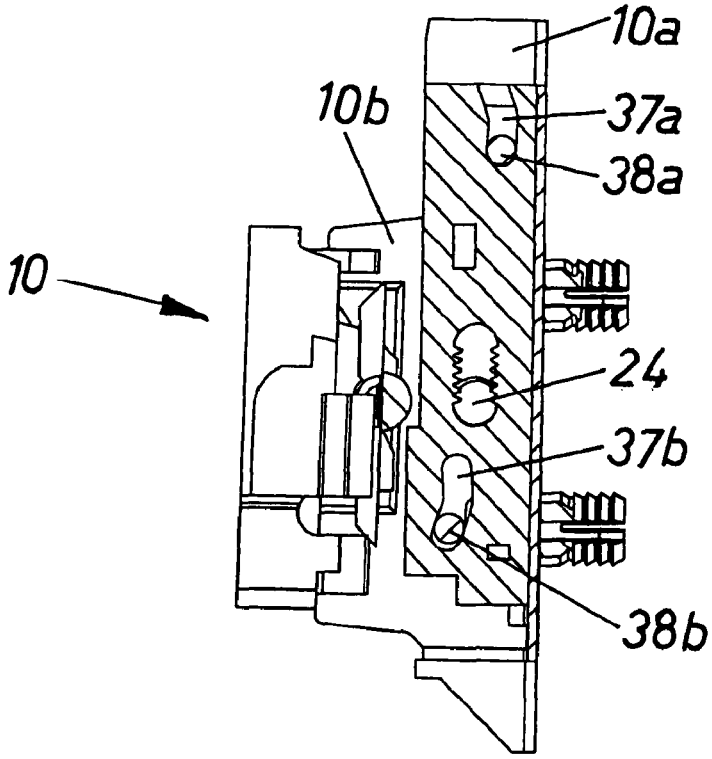

FIG. 12*a* is a vertical section through the fitting 10 of the embodiment of FIGS. 9 to 11. The part 10*b* which can be connected to the fastening device 9 of the drawer frame 4 has an angular adjustment device 24, whereby actuation of a screwdriver is able to adjust, relative to the part 10*b*, an angular adjustment plate 36 associated with the part 10*b* in the region of the front panel. The angular adjustment plate 36 has curved slots 37*a*, 37*b* which are movable relative to the stationary pins 38*a*, 38*b*. Thus, if the toothing of the angular adjustment device 24 is moved upwardly by rotational movement of a screwdriver, the part 10*a* of the fitting 10 which is in the region of the front panel adopts an inclined position relative to the part 10*b* owing to the curved slots 37*a*, 37*b*. This situation is shown in FIG. 11*b* where it can be seen that the pins 38*a*, 38*b* are located at the lower edge of the curved slots 37*a*, 37*b*. In a similar way, the fitting 10*a*—starting from the position shown in FIG. 12*a*—can be tilted out by rotating the part 10*b* in the opposite direction.

Figure 13:
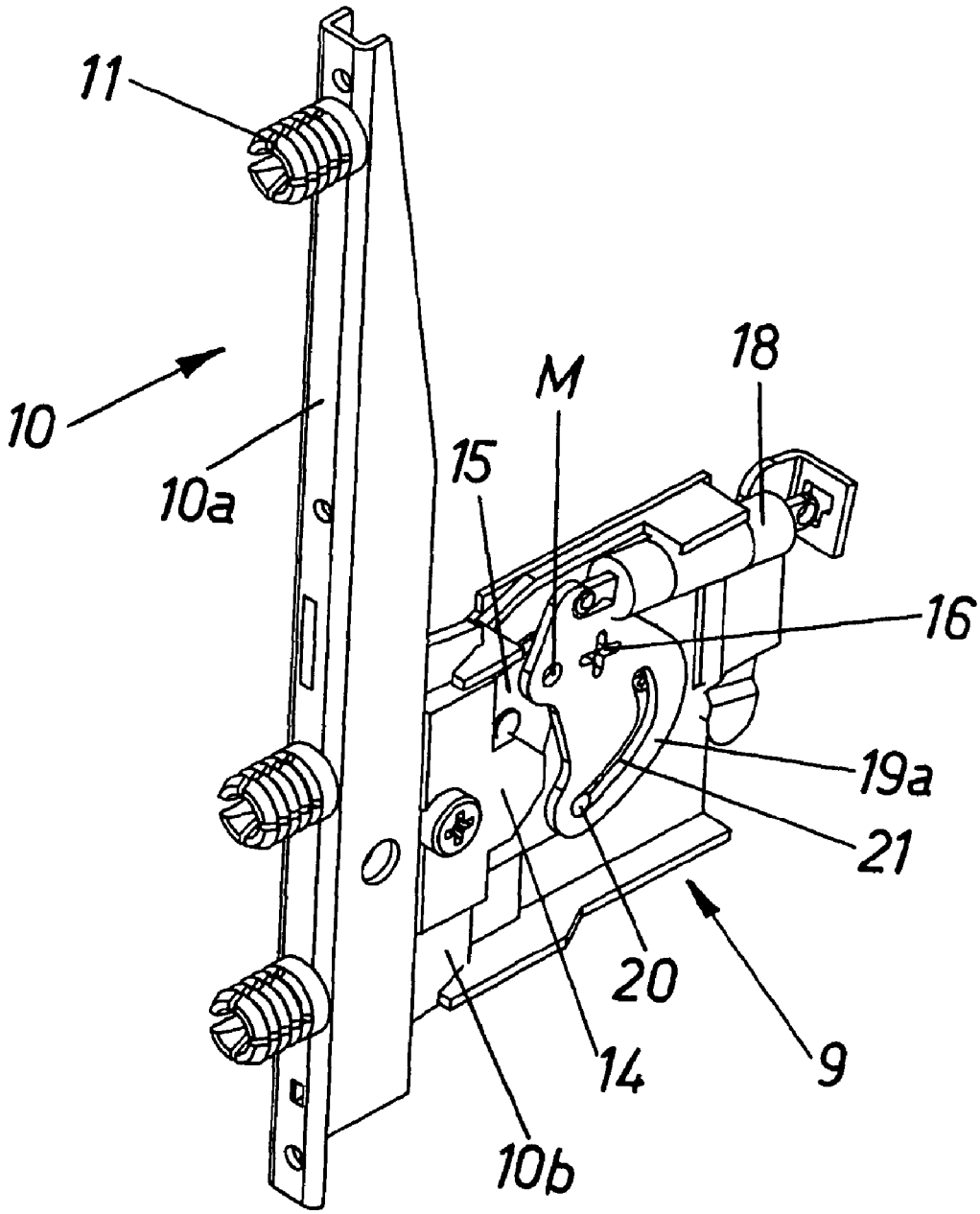
FIG. 13 shows a perspective view of the embodiment according to FIGS. 9 to 12.

FIG. 13 is a perspective view of the fitting 10 with its two parts 10*a*, 10*b*, wherein the part 10*b* can be releasably connected, and furthermore lockably attached, by way of its retaining member 14 to the fastening device 9. This drawing shows the locking device 19 with the wedge member 19*a* in the first operating position in which the catch member 15 is securely locked by way of the axis of rotation M and the wedge member 19*a* which abuts on the abutment member 20.

The invention is not restricted to the embodiments shown, but encompasses, or can be extended to, all variants and technical equivalents which can come within the scope of the claims. The position-related information chosen in the description, e.g. top, bottom, lateral, etc. relates to the drawings directly shown and described, and is to be transposed accordingly in the event of a position change.

The invention claimed is:

1. A drawer frame comprising:

a fastening device for releasable fastening of a front panel to the drawer frame;

a fitting pre-assembled to the front panel;

a spring-loaded catch member arranged in the drawer frame, the spring-loaded catch member being configured to automatically pull the fitting towards the drawer frame when engaged with one another, the catch member including a locking device in the form of a clamping device, the locking device comprising at least one wedge member rotatable about an axis, the wedge member being configured to lock the catch member in a first operating position and to release the catch member in a second operating position; and a stationary abutment member;

wherein the catch member, the wedge member, and the abutment member are configured and arranged such that, in the first operating position, the wedge member is wedged between the abutment member and the catch member, the abutment member being spaced apart from the catch member.

2. The drawer frame according to claim 1, wherein the locking device is configured to automatically clamp the catch member in the position in which it retains the fitting by the force of a spring.

3. The drawer frame according to claim 1, wherein, in order to adjust a position of the front panel relative to the drawer frame, the locking device is releasable by means of a release device.

4. The drawer frame according to claim 1, wherein the wedge member has a guide track surface contacting the abutment member in the first operating position.

5. The drawer frame according to claim 4, wherein the wedge member has at least one guide track along which the wedge member can run on the abutment member.

6. The drawer frame according to claim 4, wherein the abutment member is formed by a journal which is stationary relative to the drawer frame.

7. The drawer frame according to claim 1, wherein the wedge member can be acted upon by a spring configured to urge the wedge member towards the first operating position.

8. The drawer frame according to claim 7, wherein the spring is formed by the spring of the catch member or by a spring separate therefrom.

9. The drawer frame according to claim 1, wherein the wedge member can be moved out of the first operating position and into the second operating position by a release device.

10. The drawer frame according to claim 9, wherein the release device has an outwardly accessible receiving section for receiving a tool by means of which the wedge member can be moved.

11. The drawer frame according to claim 10, wherein the receiving section is arranged or formed directly on the wedge member.

12. The drawer frame according to claim 1, wherein, in one operating position of the wedge member, at least one adjustment device is outwardly accessible on the drawer frame for allowing adjusting of the relative position of the front panel.

13. The drawer frame according to claim 12, wherein the drawer frame has an opening which is provided for passage of a tool, wherein in a first depth position of the drawer frame the release device is accessible and therein permits unlocking of the locking device, and in a second depth position of the drawer frame the adjustment device is accessible and therein permits adjustment of the fitting relative to the drawer frame.

14. The drawer frame according to claim 12, wherein the adjustment device comprises an angular adjustment device for allowing adjustment of an inclination of the front panel relative to the drawer frame.

15. The drawer frame according to claim 12, wherein the adjustment device comprises at least one selected from the group of a height adjustment device and a lateral adjustment device for the front panel.

16. The drawer frame according to claim 1, wherein the catch member has a receiving section for receiving a tool by means of which the catch member can be moved out of an arresting position, thereby releasing the fitting.

17. The drawer frame according to claim 1, wherein the fitting comprises at least two members which can be connected together and which can be adjusted relative to one another by at least one adjustment device.

18. The drawer frame according to claim 1, wherein a height of the fitting projects beyond a height of the drawer frame.

19. The drawer frame according to claim 1, wherein, in the top front region of the drawer frame, there is an opening for a fitting to pass therethrough.

20. The drawer frame according to claim 1, wherein the fitting has a retaining device for at least one frame insert which has a plate-shaped configuration.

21. The drawer frame according to claim 1, wherein the drawer frame comprises a double-walled hollow chamber frame.

22. The drawer frame according to claim 21, wherein all components of the fastening device are arranged inside the double-walled hollow chamber frame.

23. A drawer having a drawer frame according to claim 1.

24. A piece of furniture having a drawer according to claim 23.

25. A drawer frame comprising:

a fastening device for releasable fastening of a front panel to the drawer frame;

a fitting pre-assembled to the front panel; and a spring-loaded catch member arranged in the drawer frame, the spring-loaded catch member being configured to automatically pull the fitting towards the drawer frame when engaged with one another, the catch member including a locking device in the form of a clamping device, the locking device comprising at least one wedge member rotatable about an axis, the wedge member being configured to lock the catch member in a first operating position and to release the catch member in a second operating position;

wherein the wedge member can be moved out of the first operating position and into the second operating position by a release device;

wherein the release device has an outwardly accessible receiving section for receiving a tool by means of which the wedge member can be moved; and wherein the receiving section is arranged or formed on an intermediate lever, separate from the wedge member, by means of which the wedge member is movable.

26. A drawer frame comprising:

a fastening device for releasable fastening of a front panel to the drawer frame;

a fitting pre-assembled to the front panel; and a spring-loaded catch member arranged in the drawer frame, the spring-loaded catch member being configured to automatically pull the fitting towards the drawer frame when engaged with one another, the catch member including a locking device in the form of a clamping device, the locking device comprising at least one wedge member rotatable about an axis, the wedge member being configured to lock the catch member in a first operating position and to release the catch member in a second operating/position;

wherein, in one operating position of the wedge member, at least one adjustment device is outwardly accessible on the drawer frame for allowing adjusting of the relative position of the front panel;

wherein the adjustment device comprises an angular adjustment device for allowing adjustment of an inclination of the front panel relative to the drawer frame; and wherein the angular adjustment device has a translation mechanism, whereby a rotary movement of an adjustment wheel of the angular adjustment device is converted into an angular adjustment of the front panel by the translation mechanism.

27. The drawer frame according to claim 26, wherein the translation mechanism has a lever apparatus for tilting the fitting relative to the front of the drawer frame.

28. The drawer frame according to claim 27, wherein the lever apparatus has respective levers, including a first lever traveling at least regionally along the top side, and a second lever traveling at least regionally along the bottom side of the drawer frame, wherein the first lever and the second lever are connected to each other by a two-armed shift lever.

* * * * *